US008753752B2

(12) United States Patent
Fujii et al.

(10) Patent No.: US 8,753,752 B2
(45) Date of Patent: Jun. 17, 2014

(54) METAL PLATE FOR HEAT EXCHANGE AND METHOD FOR MANUFACTURING METAL PLATE FOR HEAT EXCHANGE

(75) Inventors: Yasuyuki Fujii, Kobe (JP); Akio Okamoto, Tokyo (JP)

(73) Assignee: Kobe Steel, Ltd., Kobe-shi (JP)

( * ) Notice: Subject to any disclaimer, the term of this patent is extended or adjusted under 35 U.S.C. 154(b) by 235 days.

(21) Appl. No.: 13/377,053

(22) PCT Filed: Jun. 1, 2010

(86) PCT No.: PCT/JP2010/059288

§ 371 (c)(1),
(2), (4) Date: Dec. 8, 2011

(87) PCT Pub. No.: WO2010/143564

PCT Pub. Date: Dec. 16, 2010

(65) Prior Publication Data

US 2012/0077055 A1 Mar. 29, 2012

(30) Foreign Application Priority Data

Jun. 8, 2009 (JP) ..... 2009-137233

(51) Int. Cl.

| | |
|---|---|
| ***B21D 53/02*** | (2006.01) |
| ***F28F 3/04*** | (2006.01) |
| ***F28F 13/02*** | (2006.01) |
| ***F28F 21/08*** | (2006.01) |

(52) U.S. Cl.

CPC ..... *B21D 53/02* (2013.01); *F28F 3/048* (2013.01); *F28F 13/02* (2013.01); *F28F 21/08* (2013.01)

USPC ..... 428/600; 29/890.03; 165/133; 72/252.5

(58) Field of Classification Search

None

See application file for complete search history.

(56) References Cited

U.S. PATENT DOCUMENTS 3,454,081 A * 7/1969 Kun et al. ..... 165/133
3,566,514 A * 3/1971 Szumigala ..... 29/558

(Continued)

FOREIGN PATENT DOCUMENTS

EP 1 818 641 A1 8/2007
JP 62-37693 2/1987

(Continued)

OTHER PUBLICATIONS

Korean Office Action issued May 2, 2013, in Korea Patent Application No. 10-2011-7029252.

(Continued)

*Primary Examiner* — John J Zimmerman

(74) *Attorney, Agent, or Firm* — Oblon, Spivak, McClelland, Maier & Neustadt, L.L.P.

(57) ABSTRACT

The present invention provides a metal plate for heat exchange which facilitates nucleate boiling and is extremely excellent in heat conductivity. In the metal plate for heat exchange of the present invention, a recess part 2 having a depth of 5 μm or more and 10% or less of a plate thickness of the metal plate is formed. A crevasse part 7 is formed at least at a bottom corner 6 of the recess part 2. The crevasse part 7 is formed by cutting away the bottom corner 6 of the recess part 2 in the thickness direction. An angle θ formed by one cut-away surface and the other cut-away surface is 90 degrees or less. In addition, the crevasse part 7 is formed by cutting away a crystal grain 9. The recess part 2 is formed on the surface of the metal plate 1 by pressing a working part 14 formed on a surface of a working roll 12 against the surface of the metal plate 1 being carried.

12 Claims, 7 Drawing Sheets

(56) References Cited

U.S. PATENT DOCUMENTS

| | | | | | |
|---|---|---|---|---|---|
| 4,040,479 | A | * | 8/1977 | Campbell et al. | 165/133 |
| 4,044,797 | A | * | 8/1977 | Fujie et al. | 138/38 |
| 4,660,630 | A | * | 4/1987 | Cunningham et al. | 165/133 |
| 4,765,905 | A | | 8/1988 | Kitamura et al. | |
| 5,052,476 | A | * | 10/1991 | Sukumoda et al. | 165/133 |
| 5,259,448 | A | * | 11/1993 | Masukawa et al. | 165/133 |
| 5,415,225 | A | | 5/1995 | Randlett et al. | |
| 6,176,301 | B1 | * | 1/2001 | Bennett et al. | 165/133 |
| 8,091,616 | B2 | * | 1/2012 | Lu et al. | 165/133 |
| 2002/0092644 | A1 | * | 7/2002 | Beutler et al. | 165/133 |
| 2002/0096314 | A1 | * | 7/2002 | Liu et al. | 165/133 |
| 2005/0145377 | A1 | * | 7/2005 | Thors et al. | 165/133 |
| 2007/0034361 | A1 | * | 2/2007 | Lu et al. | 165/133 |
| 2007/0199684 | A1 | | 8/2007 | Sasaki et al. | |

FOREIGN PATENT DOCUMENTS

| | | | |
|---|---|---|---|
| JP | 62-110704 | | 5/1987 |
| JP | 1-317637 | * | 12/1989 |
| JP | 5-79781 | | 3/1993 |
| JP | 2002-168576 | | 6/2002 |
| JP | 2003-211245 | | 7/2003 |
| JP | 2006-162100 | | 6/2006 |
| JP | 2006-239744 | | 9/2006 |
| JP | 2009-136893 | * | 6/2009 |
| KR | 10-2005-0047855 | | 5/2005 |

OTHER PUBLICATIONS

Written Opinion of the International Searching Authority issued Aug. 17, 2010, in PCT/JP2010/059288, filed Jun. 1, 2010 (with English-language translation).

Office Action issued on Feb. 26, 2013 in the corresponding Chinese Patent Application No. 201080025123.0 (with English Translation).

Extended European Search Report issued Oct. 8, 2013 in Patent Application No. 10786095.9.

* cited by examiner

METAL PLATE FOR HEAT EXCHANGE AND METHOD FOR MANUFACTURING METAL PLATE FOR HEAT EXCHANGE

TECHNICAL FIELD

The present invention relates to a metal plate for heat exchange and a method for manufacturing the metal plate for heat exchange.

BACKGROUND ART

Heretofore, a heat exchange plate for use in heat exchangers and the like is desired to have a high heat conductivity. For improving the heat conductivity, it is better to form micron-order fine irregularities on the surface of the plate. As a method for transferring such micron-order fine irregularities, a number of techniques have been developed, for example, as shown in Patent Document 1.

According to the transferring method onto the surface of a metal plate in Patent Document 1, a metal sheet is carried by the rotation of carrying rolls. Further, by pressing the irregularities-formed transferring part of the outer periphery of a transfer roll against the metal sheet being carried, a transferred part of irregularities that are almost the same as those of the transferring part of the transfer roll is formed on the surface of the metal sheet.

CITATION LIST

Patent Document

Patent Document 1: JP-A 2006-239744

SUMMARY OF THE INVENTION

Problems to Be Solved by the Invention

However, in the case where the metal sheet produced according to the method shown in Patent Document 1 is used as a metal plate for heat exchange, it could not be said that the heat conductivity thereof could be in fact sufficient as the metal plate for heat exchange (plate heat exchanger (PHE)) for which gas-liquid two-phase media are assumed. Accordingly, it is desired to further improve the heat conductivity.

Given the situation and in consideration of the above-mentioned problems, it is an object of the present invention to provide a metal plate for heat exchange, which facilitates nucleate boiling and has an excellent heat conductivity, and a method for manufacturing the metal plate for heat exchange.

Means for Solving the Problems

For attaining the above-mentioned object, the following technical means were taken in the invention.

Namely, a gist of the invention is directed to a metal plate for heat exchange, wherein a recess part having a depth of 5 μm or more and 10% or less of a plate thickness of the metal plate is formed, and a crevasse part is formed at least at a bottom corner of the recess part.

Preferably, the crevasse part is formed through oxidation of a grain boundary or by cutting away the bottom corner of the recess part in the depth direction, and an angle formed by one cut-away surface and the other cut-away surface is 90 degrees or less. Also preferably, the crevasse part is formed through oxidation of the grain boundary or by cutting away a crystal grain.

The other gist of the invention is directed to a method for manufacturing a metal plate for heat exchange, which comprises pressing a working part formed on a surface of a working roll against a surface of a metal plate being carried, thereby forming a recess part having a depth of 5 μm or more and 10% or less of a plate thickness of the metal plate on the surface of the metal plate, and cutting away a bottom corner of the recess part to thereby form a crevasse part.

Preferably, after the recess part is formed, the bottom corner of the recess part is pickled to oxidize a grain boundary at the bottom corner or to cut away a crystal grain at the bottom corner, thereby forming the crevasse part. Also preferably, the bottom corner is pickled with a mixed solution of nitric acid and hydrofluoric acid.

Effect of the Invention

According to the invention, a metal plate for heat exchange which facilitates nucleate boiling and is extremely excellent in heat conductivity is obtained.

EMBODIMENTS FOR CARRYING OUT THE INVENTION

Embodiments of the invention are described below with reference to the drawings.

Figure 1:
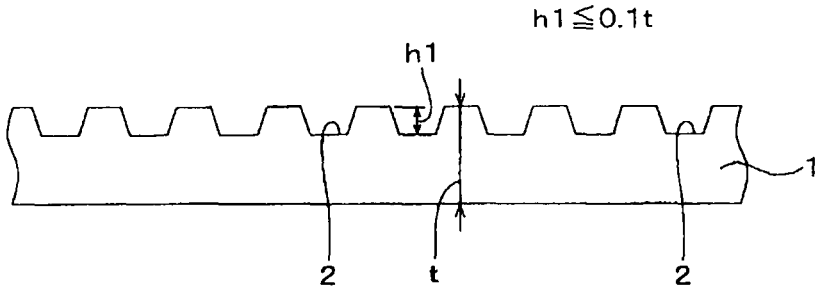
FIG. 1 is a view of a metal plate for heat exchange, in which recess parts are formed on the surface thereof.
Figure 2:
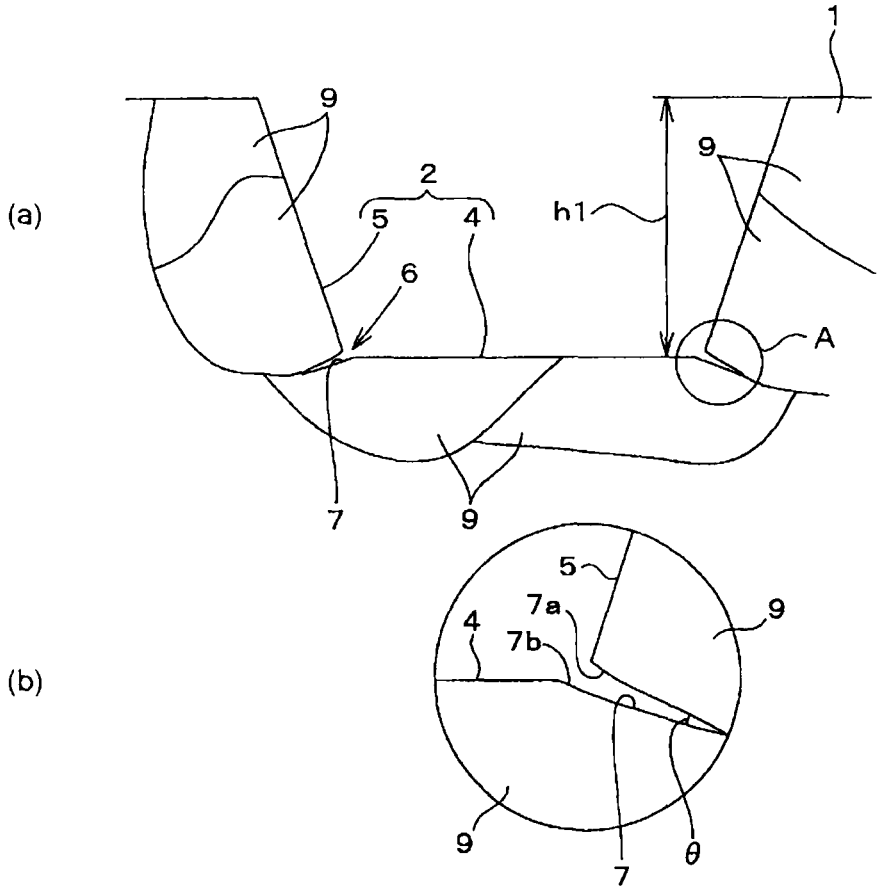
FIG. 2(*a*) shows the form of a recess part, and FIG. 2(*b*) is an enlarged view of the part A in FIG. 2(*a*).

FIG. 1 and FIG. 2 show the metal plate for heat exchange of the invention.

From the viewpoint of better heat conductivity (higher heat-transfer coefficient), most suitably, the metal plate 1 for heat exchange (metallic PHE) is microprocessed to form irregularities on the surface thereof, whereby the surface area thereof is increased, and the irregularities are so designed as to facilitate nucleate boiling.

Accordingly, multiple recess parts 2 are formed on the surface of the metal plate 1 of the invention. The recess part 2 is composed of a horizontal wall 4 extending in the longitudinal direction on the cross-sectional view, and a vertical wall 5 extending in the thickness direction from both sides of the horizontal wall 4 (from both sides in the carrying direction), and has a trapezoidal cross section. The cross section of the recess part 2 may have a semi-circular form other than the trapezoidal form. At the bottom corner 6 at which the horizontal wall 4 and the vertical wall 5 cross, a crevasse part 7 is formed for promoting nucleate boiling.

The crevasse part 7 is formed by cutting away the part, at which the horizontal wall 4 before the formation of the crevasse part 7 and the vertical wall 5 before the formation of the crevasse part 7 cross, by a few μm in the thickness direction. Namely, the metal plate 1 is composed of crystal grains 9 of generally tens μm in size, and crevasse parts 7 of a few μm in size are formed by intentionally cutting away the crystal grains 9 at around the bottom corner 6, or through oxidation of the grain boundary.

As in the above, since the crevasse part 7 has a size of a few μm and is extremely small, the crevasse part 7 becomes a gas pit of which a gas may be readily generated inside, and bubbles (gas phase) are grown by the gas in the gas pit. Namely, the crevasse part 7 is a bubble generation point.

In the metal plate 1 of the invention, since the crevasse part 7 is formed at the bottom corner 6 of the recess part 2 formed on the surface, heat is easily transmitted from both sides of the vertical wall 5 and the horizontal wall 4 to the bubbles in the crevasse part 7. Accordingly, the growth of the bubbles is thereby promoted to provide a condition capable of more facilitating nucleate boiling. In particular, since the crevasse part 7 is formed by cutting away the crystal grains 9 or through oxidation of the grain boundary, the angle θ to be formed by one surface 7*a* of the crevasse part 7 (the surface on the side of the vertical wall 5) and the other surface 7*b* of the crevasse part 7 (the surface on the side of the horizontal wall 4) is 90 degrees or less. Accordingly, bubbles can readily grow between one surface 7*a* of the crevasse part 7 and the other surface 7*b* of the crevasse part 7; and from this viewpoint, it can be said that the metal plate facilitates nucleate boiling.

The depth h1 of the recess part 2 (the height of the vertical wall 5) on the surface of the metal plate 1 is 5 μm or more. Forming the recess parts 2 on the surface thereof increases the surface area of the metal plate 1; however, in the case where the depth h1 of the recess part 2 is less than 5 μm, it is considered that the increase in the surface area may have little influence on the heat conductivity. Namely, in the case where the depth h1 of the recess part 2 is less than 5 μm, the recess part 2 is a dead zone for heat conduction. Since only the area other than the dead zone could enjoy the effect derived from the increase of the surface area due to the surface irregularities, the depth h1 of the recess part 2 in the metal plate 1 is 5 μm or more.

In addition, the depth h1 of the recess part 2 of the surface of the metal plate 1 is 10% or less of the plate thickness t. When the depth h1 of the recess part 2 is too large as compared with the plate thickness t, then the shape of the metal plate 1 may be deformed when forming the recess parts 2 in the metal plate 1. For example, in the case where the plate thickness t of the metal plate 1 is 0.5 mm and the depth h1 is 0.1 mm, "h1>0.1t" is led, and the shape of the metal plate 1 may readily deform and bow, and therefore, negative influence may be exerted on working of the plate by pressing.

In the recess part 2, when the plate thickness t is 0.5 mm and the depth h1 is 0.1 mm, there exist a large number of parts having a thickness of 0.4 mm and parts having a thickness of 0.5 mm. When such a metal plate 1 is worked by pressing as a plate material having a thickness of 0.5 mm, the plate may be cracked. In other words, when large irregularities are formed and when the metal plate 1 is seen as a whole, the plate thickness of the metal plate 1 could not be controlled as a nearly uniform plate thickness t, and therefore, negative influence is exerted on working of the plate by pressing. Accordingly, the depth h1 of the recess part 2 must be 10% or less of the plate thickness t.

In addition, when multiple recess parts 2 are formed on the surface of the metal plate 1 and the metal plate 1 is worked by pressing, the contact between the surface of the metal plate 1 and the pressing mold is a point contact. Accordingly, the friction coefficient when working decreases, thereby extremely facilitating the working.

Further, in the case where the surface area of the metal plate 1 is increased by multiple recess parts 2 and, for example, when a lubricant oil is supplied to the surface of the metal plate 1 when working the plate by pressing, the contact angle to the metal that is originally hydrophilic is smaller owing to the energy balance of the surface tension. Accordingly, the lubricant oil can spread easily thereon. Even in the case where the metal plate 1 is coated with a coating agent, the coating agent may be easily spread thereon owing to the increase of the surface area by the recess parts 2, and therefore, the workability of the metal plate 1 can be enhanced.

In this embodiment, the recess part 2 having a trapezoidal cross section is described; however, the form of the recess part 2 is not limited thereto. The recess part 2 may have any other form, for example, a form to be formed by electro-discharge texturing, or an embossed form of, for example, a columnar or quadratic prism, or any other form to be formed by hairline or blasting treatment.

Figure 3:
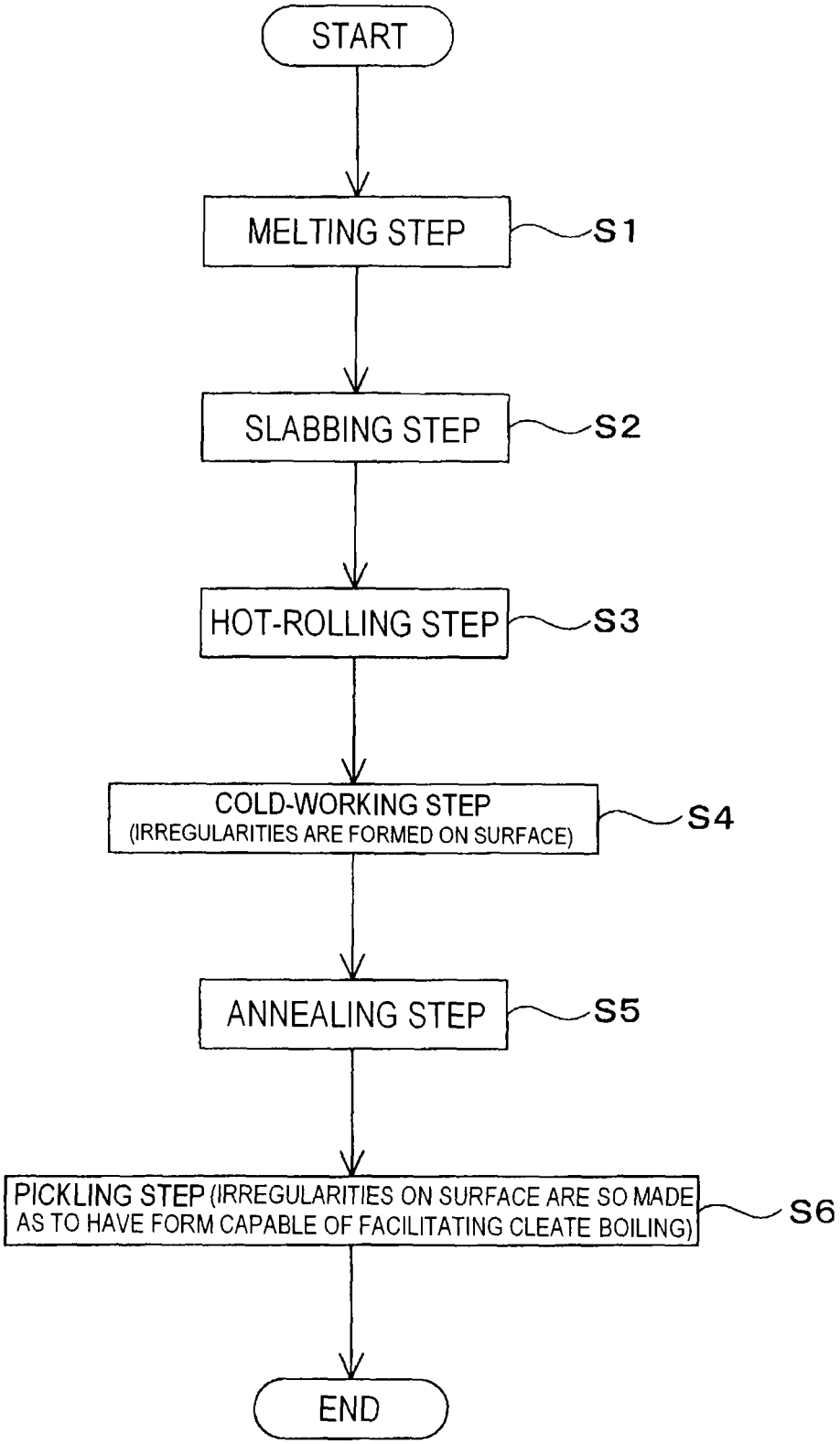
FIG. 3 is a flow chart for manufacturing a metal plate for heat exchange.

FIG. 3 shows a process for manufacturing the metal plate 1 for heat exchange.

As shown in FIG. 3, for manufacturing the metal plate 1 for heat exchange, first, titanium sponge is melted and cooled in the melting step S1 to produce an ingot. The ingot is slabbed into a plate material having a predetermined thickness in the slabbing step S2. Then, the slabbed plate material is hot-rolled to be thinned in the hot-rolling step S3, followed by cold-rolling in the cold-working step S4 in which the temperature zone is lower than that in the hot-rolling step S3. Further, the cold-rolled plate material is annealed in the annealing step S5, followed by pickling in the pickling step S6 to produce the metal plate 1 for heat exchange.

The method for manufacturing the metal plate 1 for heat exchange is described in detail hereinunder.

In the invention, recess parts 2 are formed on the surface of the metal plate (ingot) 1 in the cold-working step S4. The recess parts 2 are so formed as to have a profile (crevasse part 7) for facilitating nucleate boiling in the pickling step S6 after the cold-working step S4.

Figure 4:
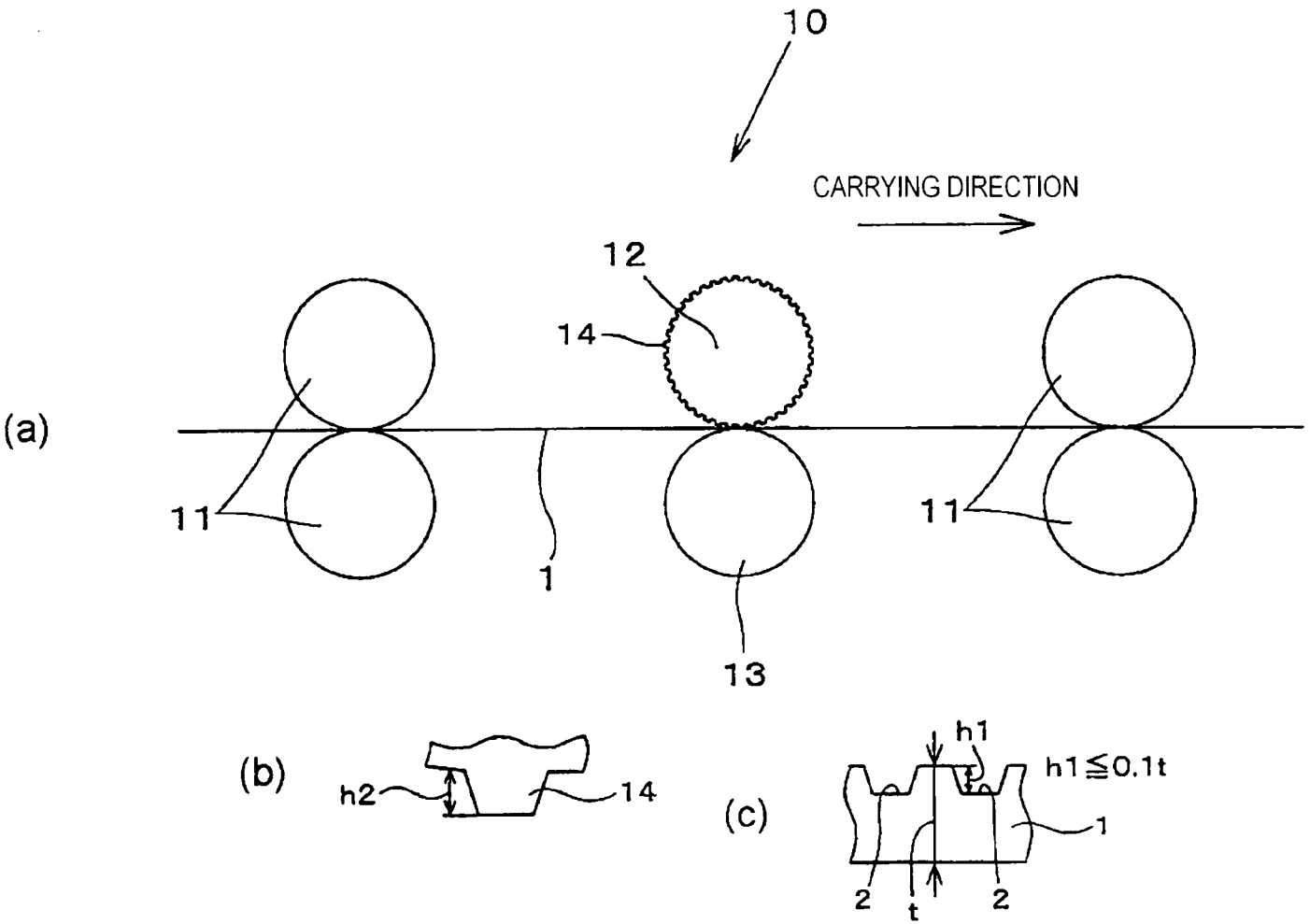
FIG. 4(*a*) is an overall view of a working apparatus, FIG. 4(*b*) is a partial enlarged view of the working part of the working roll in FIG. 4(*a*), and FIG. 4(*c*) is a partial enlarged view of the metal plate with irregularities formed thereon in FIG. 4(*a*).

FIG. 4(*a*) shows a working apparatus for forming fine irregularities on the surface of the metal plate (ingot) in the cold-working step S4. As shown in FIG. 4(*a*), the working apparatus 10 comprises carrying rolls 11, a working roll 12, and a support roll 13. The carrying rolls 11 are for carrying the metal plate 1, and are arranged on the upstream side and on the downstream side of the working roll 12. The working roll 12 is for forming micron-order irregularities (from a few μm to a few hundred μm) on the surface of the metal plate 1 being carried.

As shown in FIGS. 4(*a*) and (*b*), a working part 14 with a convex (trapezoidal convex) is formed entirely on the outer periphery of the working roll 12, and the height h2 of the working part 14 is set to be 5 μm or more. In addition, the height h2 of the working part 14 is set to be 10% or less of the plate thickness t of the metal plate 1 so that the depth h1 of the recess part 2 could be 10% or less of the plate thickness t of the metal plate 1.

Accordingly, in the working apparatus 10, while the working roll 12 is rotated, the working part 14 provided on the working roll 12 is pressed against the surface of the metal plate 1, to thereby form the recess parts 2 having the same profile as the reversed profile of the working part 14, on the surface of the metal plate 1. As shown in FIG. 4(*c*), according to the working apparatus 10, the recess parts 2 having a depth h1 of 5 μm or more and 10% or less of the plate thickness t can be formed on the surface of the metal plate 1.

It is considered that, by pressing the working part 14 against the surface of the metal plate 1, the recess parts 2 having the same profile as the reversed profile of the working part 14 could be formed on the surface of the metal plate 1. In fact, however, owing to the relationship between the carrying speed of the metal plate 1 and the peripheral speed of the working roll 12, the profile of the working part 14 could not be the same as the profile of the recess parts 2 formed on the surface in some cases.

Consequently, in the invention, the recess parts 2 having the same profile as the reversed profile of the working part 14 are made to be formed on the surface of the metal plate 1, in consideration of the relationship between the carrying speed of the metal plate 1 and the peripheral speed of the working roll 12.

Figure 5:
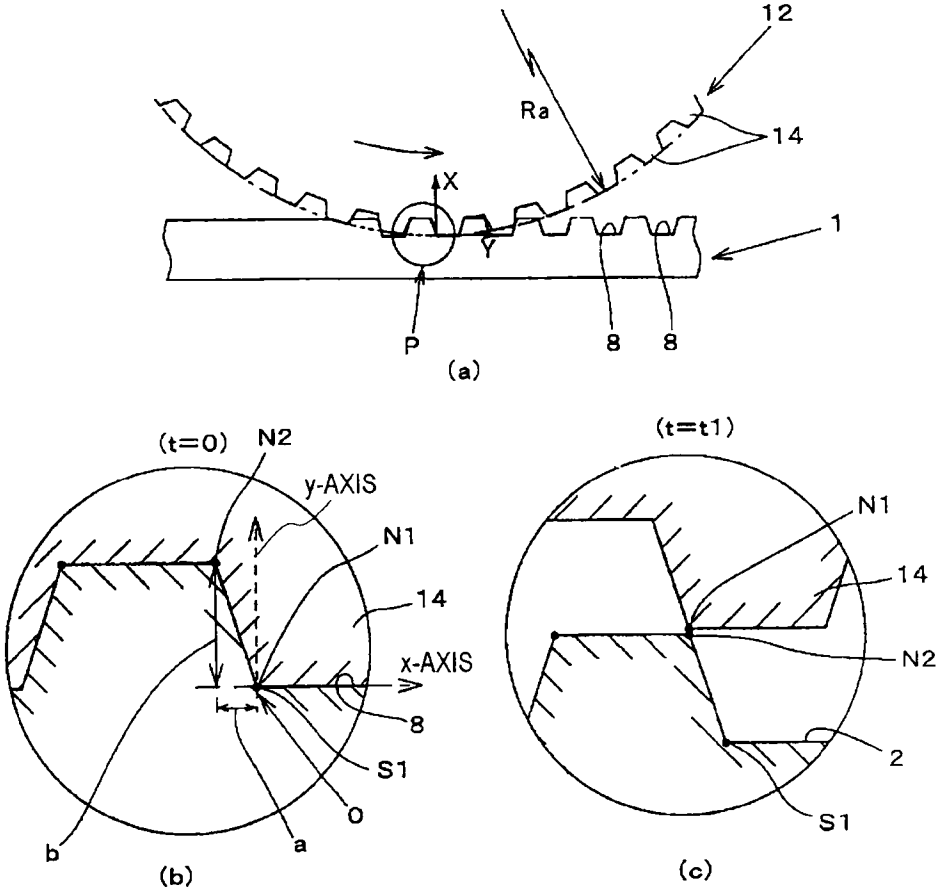
FIG. 5(*a*) is an explanatory view showing a working condition, FIG. 5(*b*) is an enlarged view of the part at t=0, and FIG. 5(*c*) is an enlarged view at t=t1.

FIG. 5 shows the condition of the working roll 12 kept in contact with the metal plate 1.

As shown in FIG. 5(*a*), the working part 14 of the working roll 12 rotating in the peripheral direction is pressed against the surface of the metal plate 1. The surface of the metal plate 1 is gradually deformed by this press, thereby forming the recess parts 2 thereon.

In the part P in FIG. 5(*a*), when working part 14 of the working roll 12 reaches nearest the surface of the metal plate 1, the time t is taken as t=0. At that time, the recess part 2 having the same profile as the reversed profile of the working part 14 of the working roll 12 is formed on the surface of the metal plate 1.

As shown in FIG. 5(*b*), at the position at t=0 where the profile of the recess part 2 is the same as the reversed profile of the working part 14, the first apex N1 positioned at the rear side in the rotating direction of the working part 14 nearly coincides with the first bottom (bottom corner) S1 positioned at the rear side in the carrying direction of the recess part 2. In this regard, the part at which the first apex N1 of the working part 14 coincides with the first bottom S1 is taken as a reference point O.

Figure 6:
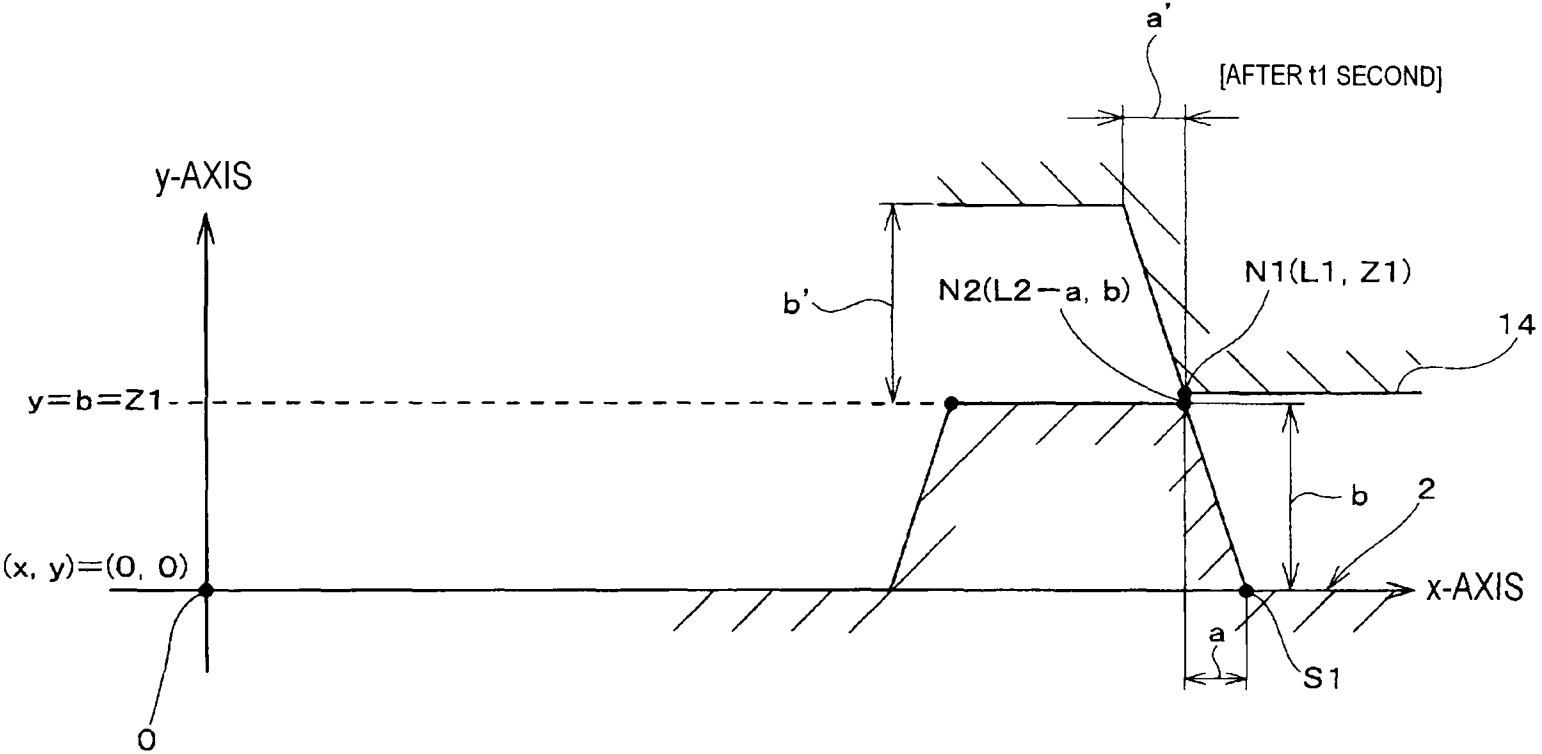
FIG. 6 is a coordinate graph showing the positional relationship between the working part and the recess part at t=t1.

FIG. 5(*c*) and FIG. 6 show the condition where the part P is carried at t=t1 (sec). The x-axis in FIG. 6 is the same as the carrying direction of the metal plate 1, and the y-axis is the same as the direction of the plate thickness t of the metal plate 1.

When the side of the working part 14 is referred to, the movement of the first apex N1 of the working part 14 after t1 seconds (t=t1) is represented by the formula (1) and the formula (2). In the formula (1) and the formula (2), L1 means the movement (horizontal movement) in the horizontal direction (x-axis direction) of the first apex N1; and L2 means the movement (vertical movement) in the vertical direction (y-axis direction) of the first apex N1.

[Numerical Formula 1]

$$L1 = Ra \cdot \sin\left(\frac{VR}{Ra} \cdot t1\right) \tag{1}$$

$$Z1 = Ra - Ra \cdot \cos\left(\frac{VR}{Ra} \cdot t1\right) \tag{2}$$

wherein

L1: horizontal movement at the first apex of the working part,

Z1: vertical movement at the first apex of the working part,

Ra: radius of the working roll,

VR: peripheral speed of the working roll, t1: time elapsed until the working part reaches the position Q from the position P.

On the other hand, when the side of the recess part 2 is referred to, the movement of the first bottom S1 of the recess part 2 after t1 seconds (t=t1) is represented by the formula (3) and the formula (4). In the formula (3) and the formula (4), L2 means the movement (horizontal movement) in the x-axis direction of the first bottom S1; and Z2 means the movement (vertical movement) in the vertical direction (y-axis direction) of the first bottom S1.

[Numerical Formula 2]

$$L2 = V \cdot t1 \tag{3}$$

$$Z2 = 0 \tag{4}$$

wherein

L2: horizontal movement at the first bottom of the recess part,

Z1: vertical movement at the first bottom of the recess part,

V: carrying speed of the metal plate at the position P, t1: time elapsed until the recess part reaches the position Q from the position P.

Toward the downstream side from the position P, the working part 14 leaves the recess part 2. After t1 seconds (t=t1) in the process where the working part 14 leaves the recess part 2, when the first apex N1 of the working part 14 is in the position toward the side of the reference point O from the second apex N2 of the metal plate 1 shifted by the distance b in the y-axis direction from the first bottom S1 of the recess part 2, then the first apex N1 and the second apex N2 overlap each other. In this case, the recess part 2 is cut away by the first apex N1 and the recess part 2 is thereby deformed.

In the case where the first apex N1 goes ahead of the second apex N2, it is considered that the recess part 2 is not cut away by the working part 14 (first apex N1) and the recess part 2 is not deformed. Accordingly, in the invention, the metal plate 1 is manufactured under the condition where the x-coordinate of the first apex N1 is larger than the x-coordinate of the second apex N2 after t1 seconds (t=t1), that is, under the condition that satisfies the formula (5). The formula (6) can be derived by coordinating the formula (5).

[Numerical Formula 3]

$$L2 - a > L1 \tag{5}$$

$$(V \cdot t1) - a > Ra \cdot \sin\left(\frac{VR}{Ra} \cdot t1\right) \tag{6}$$

More specifically, the y-coordinate at the time when the first apex N1 reaches the second apex N2 (Z1=b) is represented by the formula (7). The time t1 calculated according to the formula (7) is represented by the formula (8).

[Numerical Formula 4]

$$y = Z1 = b = Ra - Ra \cdot \cos\left(\frac{VR}{Ra} \cdot t1\right) \tag{7}$$

-continued $$t1 = \frac{Ra}{VR} \cdot F \text{ wherein } F = \cos^{-1}\left(1 - \frac{b}{Ra}\right) \quad (8)$$

The carrying speed of the metal plate 1 is represented by the formula (9) based on the formula of forward slip.

[Numerical Formula 5]

$$\text{From } Fs = \frac{V - VR}{VR}, \quad V = (1 + Fs) \cdot VR \quad (9)$$

wherein

Fs: forward slip.

The formula (8) and the formula (9) are coordinated, and then, the forward slip is represented by the formula (10).

Namely, by controlling the forward slip so as to satisfy the formula (10), the recess part 2 of the metal plate 1 is prevented from being cut away by the first apex of the working part 14, and the recess part having the same profile as the reversed profile of the working part 14 can be transferred onto the metal plate 1.

[Numerical Formula 6]

$$Fs > \frac{1}{F} \cdot \left\{\sin(F) + \frac{a}{Ra}\right\} - 1 \text{ wherein } F = \cos^{-1}\left(1 - \frac{b}{Ra}\right) \quad (10)$$

Fs: forward slip, a: horizontal distance from the reference point of the recess part to the first bottom on the carrying forward side, b: horizontal distance from the reference point of the recess part to the first bottom on the carrying forward side, Ra: radius of the working roll.

In other words, in the invention, by controlling the forward slip under the condition of the formula (10), the recess part 2 of the metal plate 1 is prevented from being cut away by the first apex of the working part 14, and the depth h1 of the recess part 2 could be the same as the height h2 of the working part 14. By pressing the working part 14 formed on the surface of the working roll 12 against the surface of the metal plate 1, the recess part 2 having a depth of 5 μm or more and 10% or less of the plate thickness of the metal plate can be formed on the surface of the metal plate 1.

More specifically, when forming the recess part 2 by means of the working part 14, first, the profile of the recess part 2, that is, the horizontal component a and the vertical component b (conversely, the horizontal component a' and the vertical component b' of the working part 14 corresponding to the recess part 2) are defined. Next, the rolling reduction of the working roll 12, the plate thickness t of the metal plate 1 at the entry/exit side of the working roll 12, and the tension and the friction coefficient on the upstream side and downstream side of the metal plate 1 are defined. Next, the conditions are varied so that the forward slip to be obtained according to the formula (11) could satisfy the formula (10). However, the vertical component b of the profile of the recess part 2 or the vertical component b' of the working part 14 is so defined that the depth h1 of the recess part 2 could be 5 μm or more and 10% or less of the plate thickness t.

[Numerical Formula 7]

$$Fs = \tan\left(\sqrt{\frac{hi}{Ri'}} \times \frac{Hn}{2}\right) \text{ wherein} \quad (11)$$

$$Hn = \sqrt{\frac{Ri'}{hi}} \cdot \tan^{-1}\left(\sqrt{\frac{Hi - hi}{hi}}\right) - \frac{1}{2\mu}\ln D$$

$$D = \frac{Hi}{hi} \cdot \frac{1 - \sigma_f / ki}{1 - \sigma_b / ki}$$

Fs: forward slip,

Hi: plate thickness at the entry side, hi: plate thickness at the exit side, $\sigma_b$: tension at the entry side, $\sigma_f$: tension at the exit side, μ: friction coefficient, ki: deformation resistance, Hn: plate thickness at the neutral point, Ri': diameter of flatter roll.

Figure 7:
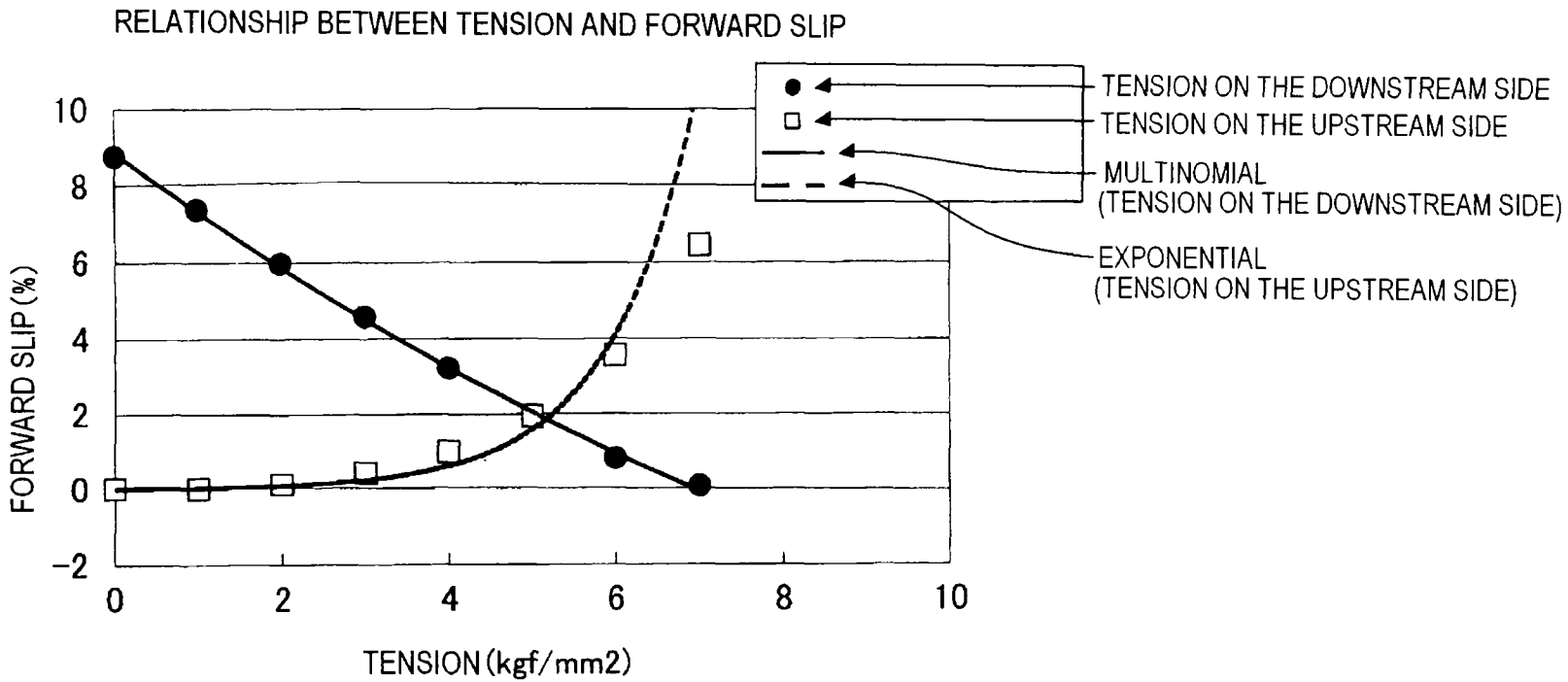
FIG. 7 is a view showing the relationship between tension and forward slip.

Heretofore, when rolling a titanium thin plate, the tension is defined to be constant both on the upstream side and on the downstream side or the tension is defined to be higher on the downstream side than on the upstream side, in order to prevent the plate from being seized owing to the slip between the roll and the plate. However, in the invention, by increasing the tension on the upstream side or by lowering the tension on the downstream side so that the forward slip could satisfy the formula (10), the profile of the recess part of the metal plate 1 is kept unchangeable. Owing to the control, the forward slip tends to decrease; however, since the roll and the plate are restrained by the recess/convex parts, there hardly occurs the problem of slip, etc. In the case where the tension on the downstream side is lowered, the peripheral speed of the carrying roll 11 on the downstream side is lowered; and in the case where the tension of the upstream side is increased, the peripheral speed of the carrying roll 11 on the upstream side is lowered. The forward slip is preferably controlled in consideration of the forward slip that changes depending on the tension, as shown in FIG. 7.

As described above, by pressing the working part 14 against the surface (upper face) of the metal plate 1 while controlling the forward slip in the cold-working step S4, the recess parts 2 can be formed on the surface of the metal plate 1.

After the recess parts 2 are formed on the surface of the metal plate 1 in the cold-working step S4, the bottom corner 6 of the recess part 2 is pickled in the pickling step S6. By the pickling, the crystal grains 9 in the bottom corner 6 are cut away or the grain boundary is oxidized, whereby the crevasse part 7 that promotes nucleate boiling is formed at the bottom corner 6.

Figure 8:
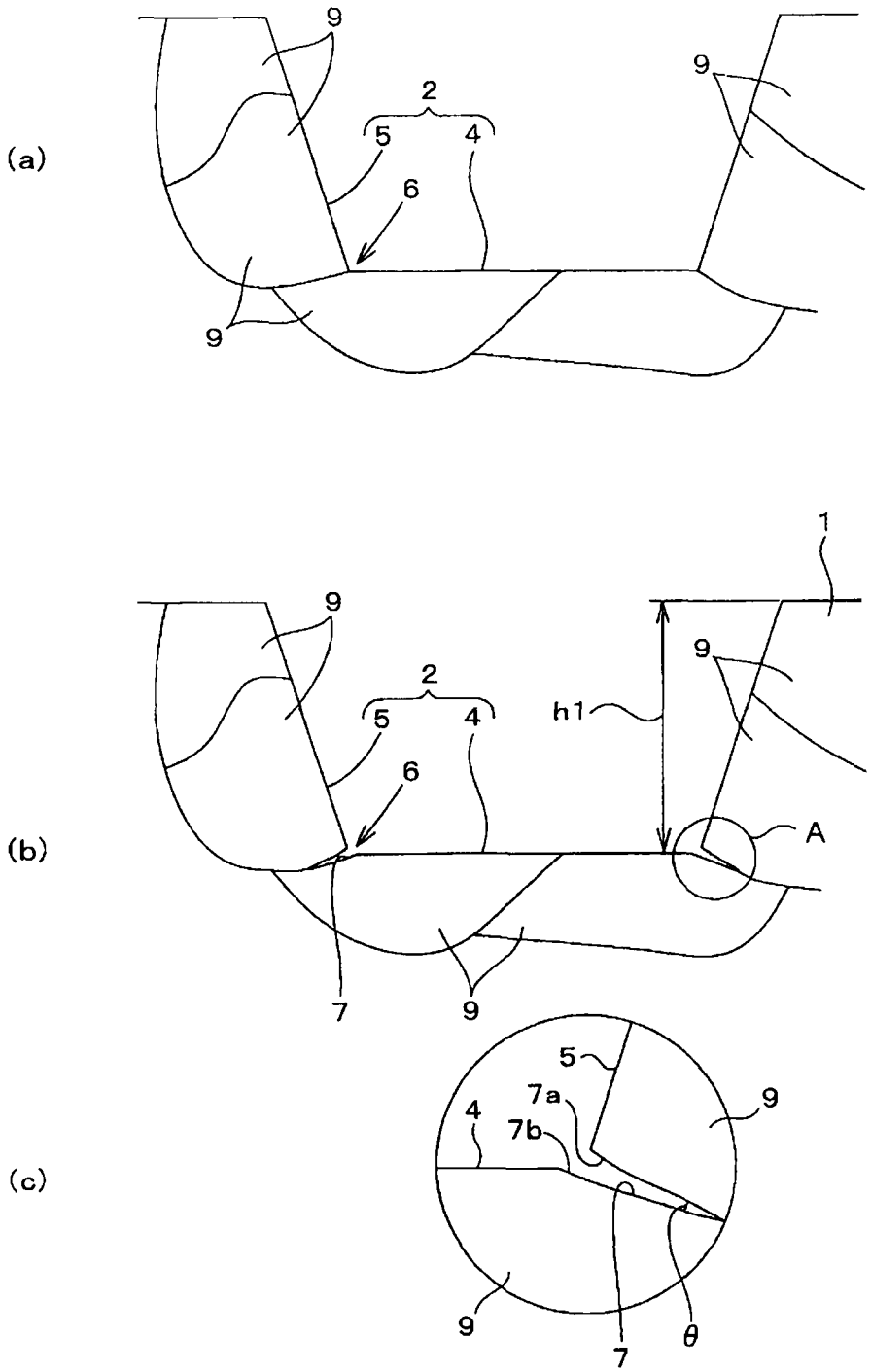
FIG. 8(*a*) shows the form of a recess part before a pickling step, FIG. 8(*b*) shows the form of the recess part after the pickling step, and FIG. 8(*c*) is an enlarged view of the part A in FIG. 8(*b*).

As shown in FIG. 8(*a*), after the recess parts 2 are formed on the surface of the metal plate 1 in the cold-working step S4 and before the picking step S6, the cross-sectional profile of the recess part 2 is composed of a horizontal wall 4 extending in the carrying direction, and the vertical wall 5 extending in the thickness direction from both sides of the horizontal wall 4 (from both sides in the carrying direction). The part at which the horizontal wall 4 and the vertical wall 5 cross is the bottom corner. Of the bottom corners 6, the part on the forward side in the carrying direction is the first bottom S1.

As shown in FIGS. 8(*b*) and (*c*), in the pickling step S6 for removing scale, etc., the metal plate 1 is dipped in a mixed solution of nitric acid and hydrofluoric acid, and the bottom corner 6 of the recess part 2 is forcedly corroded by the mixed solution. The bottom corner 6 of the recess part 2 is a part having the highest tension when forming the recess part 2 in the metal plate 1. Accordingly, in the pickling step S6, the corrosion of the bottom corner 6 is promoted, and the crystal grains 9 constituting the metal plate 1 are cut away in the thickness direction or the corrosion goes on along the grain boundary (the crystal grains 9 constituting the vertical wall 5 are cut away and simultaneously the crystal grains 9 constituting the horizontal wall 4 are cut away), whereby the crevasse part 7 is formed. In the pickling step S6, when the part other than the bottom corner 6 is protected from corrosion due to the mixed solution by masking or the like, then the crevasse part 7 can be formed only in the bottom corner 6.

As in the above, after the recess part 2 is formed, the bottom corner 6 of the recess part 2 is pickled to thereby cut away the crystal grains 9 on the side of the bottom corner 6 or to oxidize the grain boundary. Then, the angle θ formed by one surface (the surface on the side of the vertical wall 5) of the crevasse part 7 as formed by removal of the crystal grains 9, and the other surface (the surface on the side of the horizontal wall 4) of the crevasse part 7 as formed by removal of the crystal grains 9, is 90 degrees or less.

According to the manufacturing method of the invention as above, the working part 14 formed on the surface of the working roll 12 is pressed against the surface of the metal plate 1 being carried, whereby the recess parts 2 having a depth of 5 μm or more and 10% or less of the plate thickness of the metal plate are formed on the surface of the metal plate 1. Further, after the recess parts 2 are formed, the bottom corner 6 of the recess part 2 is cut away, thereby forming the crevasse part 7. Or, after the recess parts 2 are formed, the bottom corner 6 of the recess part 2 is pickled to cut away the crystal grains 9 on the side of the bottom corner 6, thereby forming the crevasse part 7.

According to the invention, it is possible to easily produce the metal plate 1 that is applicable to PHE for which gas-liquid two-phase media are assumed and is capable of facilitating nucleate boiling. Also, according to the invention, the crevasse part 7 having a size of a few μm can be easily formed without requiring any complicated production method.

It should be considered that the embodiments illustrated herein are only exemplifications in all aspects and are not limitative. The scope of the invention is not within the above-mentioned description but should be shown by the claims, and is intended to include all changes and modifications falling within the significance and scope equivalent to the claims. The present application is based on a Japanese patent application filed on Jun. 8, 2009 (Patent Application No. 2009-137233), the contents of which are incorporated herein by reference.

| Explanation of Reference Signs | |
|---|---|
| 1 | Metal Plate for Heat Exchange |
| 2 | Recess part |
| 4 | Horizontal Wall |

-continued

| Explanation of Reference Signs | |
|---|---|
| 5 | Vertical Wall |
| 6 | Bottom Corner |
| 7 | Crevasse part |
| 9 | Crystal Grain |
| h1 | Depth (depth of recess part) |

The invention claimed is:

1. A metal plate, comprising:

a recess part of trapezoidal cross section having a depth of 5 μm or more and 10% or less of a plate thickness of the metal plate and comprising a horizontal wall extending in a longitudinal direction on a cross-sectional view of the recess part and a vertical wall extending in a thickness direction from both sides of the horizontal wall, and a crevasse part at least at a bottom corner of the recess part, at which the horizontal wall and the vertical wall cross, wherein the crevasse part is obtained by a process comprising oxidizing a grain boundary or cutting away a crystal grain.

2. The metal plate according to claim 1, wherein the crevasse part is obtained by a process comprising oxidizing a grain boundary or cutting away a bottom corner of the recess part in a depth direction, and an angle formed by one cut-away surface and another cut-away surface is 90 degrees or less.

3. The metal plate of claim 1, wherein the metal plate is suitable for heat exchange.

4. A method for manufacturing a metal plate, the method comprising:

pressing a working part formed on a surface of a working roll against a surface of a metal plate, thereby forming a recess part having a depth of 5 μm or more and 10% or less of a plate thickness of the metal plate on the surface of the metal plate, and cutting away a bottom corner of the recess part, thereby forming a crevasse part.

5. The method according to claim 4, further comprising:

after forming the recess part, pickling the bottom corner of the recess part, thereby forming the crevasse part by oxidizing a grain boundary at the bottom corner or cutting away a crystal grain at the bottom corner.

6. The method according to claim 5, wherein the pickling is with a mixed solution of nitric acid and hydrofluoric acid.

7. The method of claim 4, wherein an angle formed by one cut-away surface of the crevasse part and the other cut-away surface of the crevasse part is 90 degrees or less.

8. The method of claim 4, wherein the cutting away a bottom corner of the recess part comprises cutting away the bottom corner in a depth direction.

9. The method of claim 4, wherein the recess part has a trapezoidal cross section.

10. The method of claim 9, wherein the bottom corner is a point at which a horizontal wall and a vertical wall cross.

11. The method of claim 4, further comprising supplying a lubricant oil to the surface of the metal plate during the pressing.

12. The method of claim 4, wherein the metal plate is suitable for heat exchange.

* * * * *